US006086418A

United States Patent [19]

Chang

[11] Patent Number: 6,086,418

[45] Date of Patent: Jul. 11, 2000

[54] ELECTRICAL CONNECTOR

[75] Inventor: Yao-Hao Chang, Chung-Ho, Taiwan

[73] Assignee: Hon Hai Precision Ind. Co., Ltd., Taipei Hsien, Taiwan

[21] Appl. No.: 09/412,963

[22] Filed: Oct. 5, 1999

[30] Foreign Application Priority Data

Apr. 9, 1999 [TW] Taiwan ..... 88205507

[51] Int. Cl.[7] ..... H01R 13/73

[52] U.S. Cl. ..... 439/573; 439/567

[58] Field of Search ..... 439/573, 567, 439/571, 572, 570

[56] References Cited

U.S. PATENT DOCUMENTS

| | | | |
|---|---|---|---|
| 4,943,244 | 7/1990 | Teck et al. | 439/567 |
| 5,228,873 | 7/1993 | Hirai | 439/573 |
| 5,249,983 | 10/1993 | Hirai | 439/573 |
| 5,540,598 | 7/1996 | Davis | 439/79 |
| 5,616,052 | 4/1997 | Pan et al. | 439/573 |
| 5,630,730 | 5/1997 | Wang et al. | 439/567 |
| 5,709,556 | 1/1998 | Tan et al. | 439/567 |
| 5,727,970 | 3/1998 | Koguchi et al. | 439/108 |
| 6,012,949 | 1/2000 | Lok | 439/570 |

*Primary Examiner*—Gary F. Paumen
*Attorney, Agent, or Firm*—Wei Te Chung

[57] ABSTRACT

An electrical connector includes an insulative housing, a number of terminals, a locking device and an engaging member. The housing forms a D-sub projection defining a number of passageways for receiving the terminals therein. The locking device has a pair of locking feet extending through a circuit board for fixing the housing to the circuit board. The engaging member forms a screw hole engaging with a screw for further securing the housing to the circuit board.

1 Claim, 7 Drawing Sheets

ELECTRICAL CONNECTOR

BACKGROUND OF THE INVENTION

The present invention relates to an electrical connector, and particularly to an electrical connector having a locking device for reliably securing the electrical connector to a circuit board.

U.S. Pat. Nos. 4,943,244; 5,540,598; 5,630,730; 5,709,556; and 5,727,970 each disclose a conventional connector to be mounted on a circuit board. Referring to FIG. 1, a conventional electrical connector 85 is mounted to a circuit board 84 by a locking device 80. The locking device 80 has a fixing portion 83, a base 82 and a pair of feet 81. The fixing portion 83 is attached to a housing 851 of the connector 85, and protrusions 811 of the feet 81 extend into a hole 841 of the circuit board 84 to secure the electrical connector 85 to the circuit board 84 and to properly position terminals to contact corresponding solder pads. However, the conventional connector 85 is supported on the circuit board 84 only by the protrusions 811, thus, if there is a need for repeated insertions/withdraws then the connection between the terminals and the solder pads of the circuit board 84 is not reliable, and signal transmission will be adversely affected.

BRIEF SUMMARY OF THE INVENTION

A main object of the present invention is to provide an electrical connector having a locking device for reliably securing the connector to a circuit board.

Another object of the present invention is to provide an electrical connector having a locking device which is easily assembled to the electrical connector for facilitating assembly.

To fulfill the above-mentioned objects, according to a preferred embodiment of present invention, an electrical connector comprises an insulative housing, a plurality of terminals, a locking device and an engaging member. The locking device is formed by stamping a metal plate, and comprises a base, first and second folded sections. The first and second folded sections extend from opposite edges of the base, and an opening is formed in the second folded section. A pair of locking feet extends from the base for insertion into a corresponding hole of a circuit board. The engaging member forms a screw hole for engaging with a screw and securing the housing to the circuit board. Flanges oppositely extend from the engaging member for engaging with corresponding slots formed in the housing, therefore, movement of the engaging member is restricted.

Other objects, advantages and novel features of the invention will become more apparent from the following detailed description when taken in conjunction with the accompanying drawings.

DETAILED DESCRIPTION OF THE INVENTION

Figure 1:
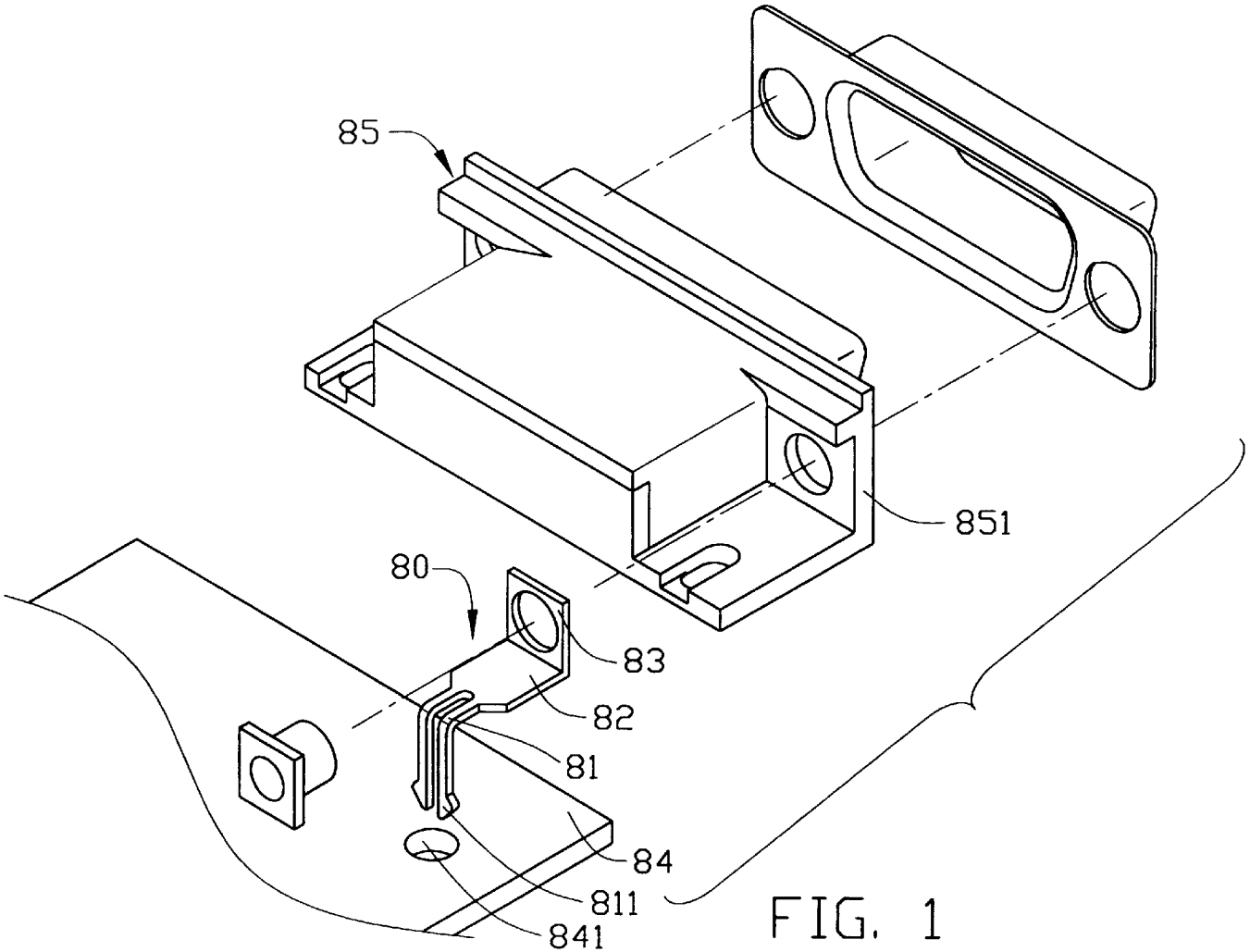
FIG. 1 (PRIOR ART)
FIG. 1 is a perspective view of a conventional electrical connector.
Figure 2:
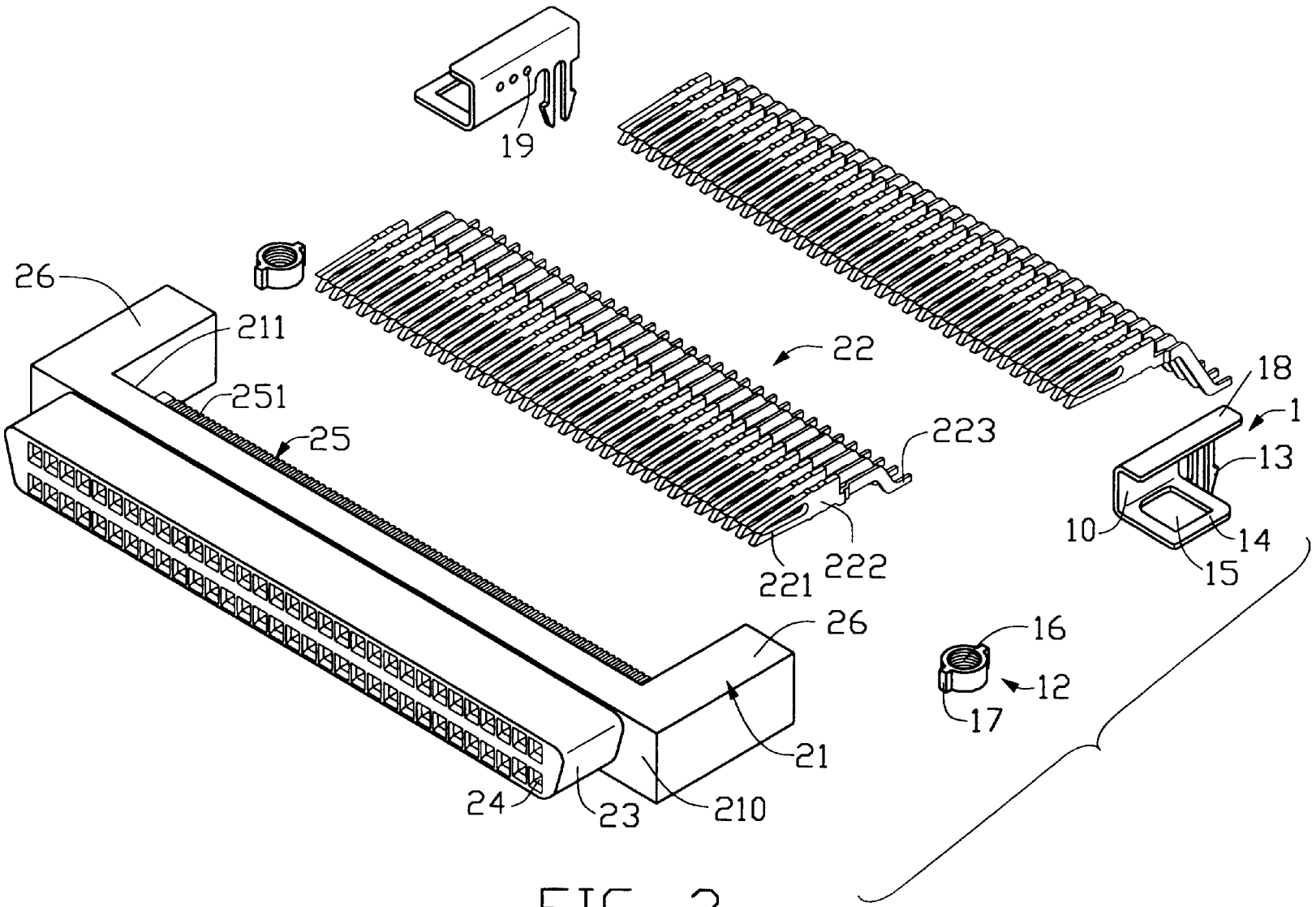
FIG. 2 is an exploded view of an electrical connector in accordance with the present invention.
Figure 3:
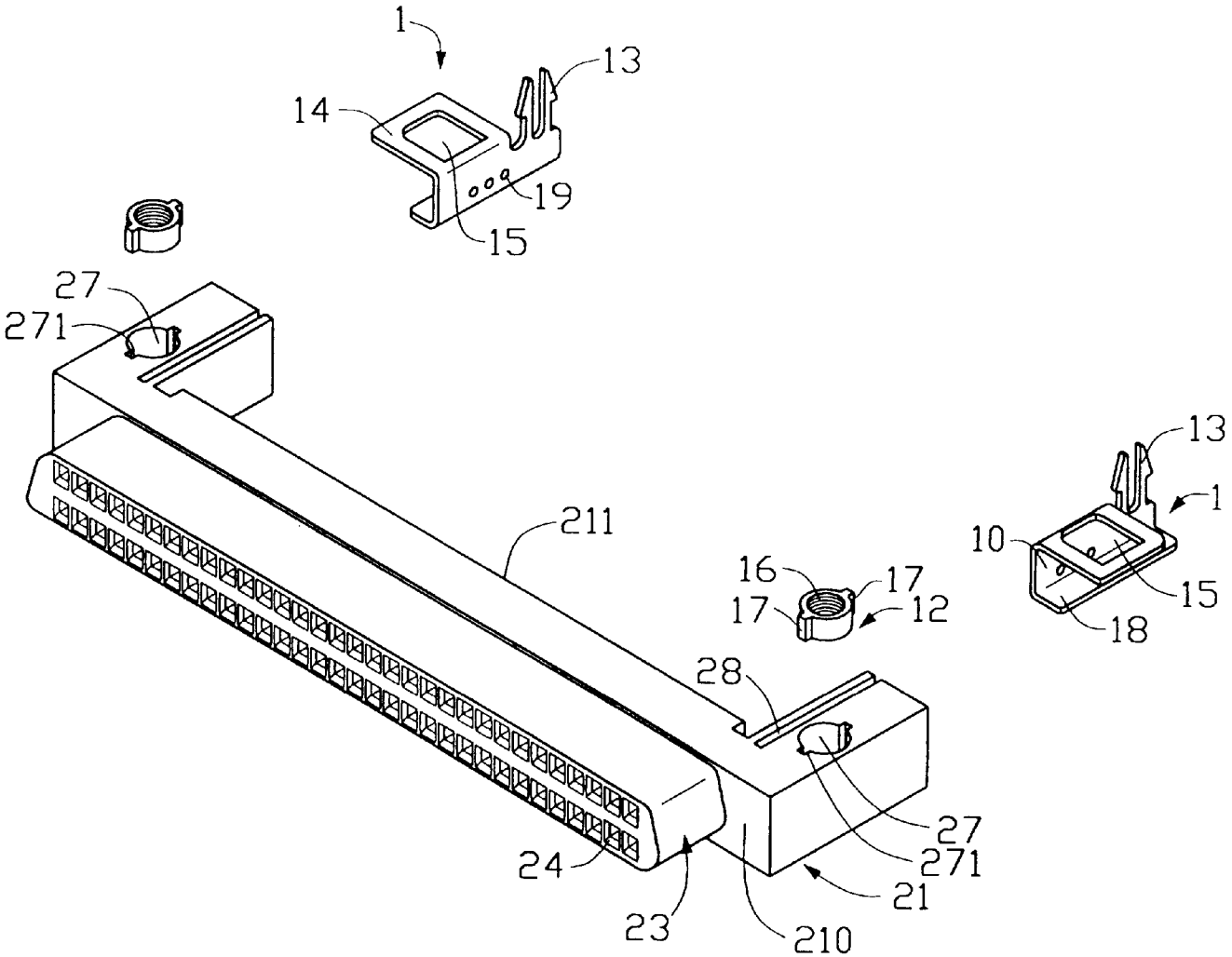
FIG. 3 is a perspective view of a housing and a pair of locking devices and engaging members of the electrical connector.
Figure 6:
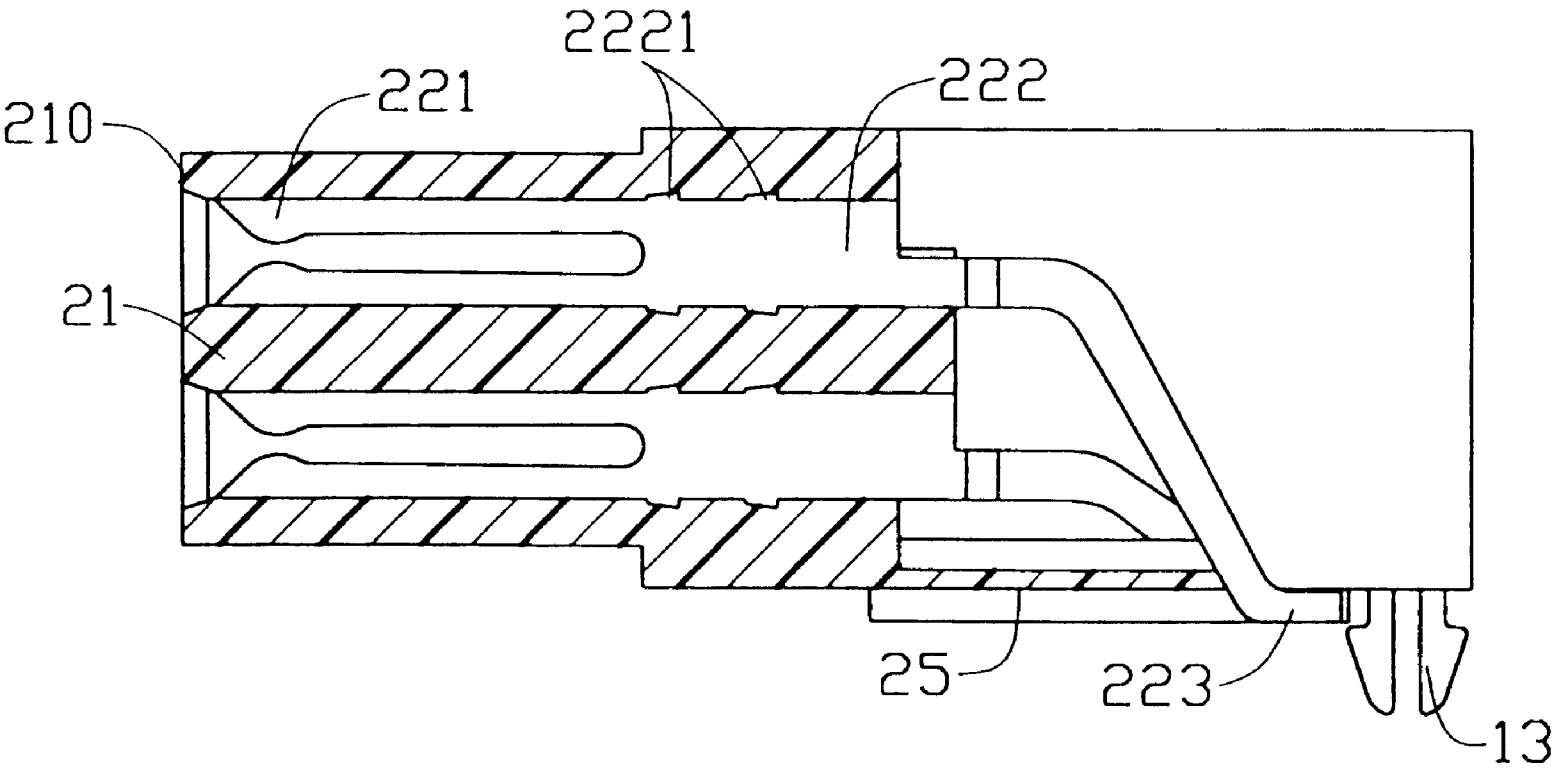
FIG. 6 is a cross-sectional view taken along line 4—4 of FIG. 4.

Referring to FIGS. 2, 3 and 6, an electrical connector comprises an insulative housing 21, a pair of locking devices 1, a pair of engaging members 12 and a plurality of terminals 22. The housing 21 has an engaging face 210 and a rear face 211 on opposite sides thereof. A D-shaped engaging portion 23 is formed on the engaging face 210 of the housing 21. A plurality of passageways 24 is formed in the engaging portion 23 and extends through the housing 21 between the engaging face 210 and the rear face 211. The terminals 22 are received in the corresponding passageways 24. A spacing portion 25 having a plurality of spacing slots 251 is formed on the housing 21 proximate the rear face 211. A pair of arms 26 extends from lateral ends of the housing 21. Each arm 26 defines a receiving hole 27 in the bottom surface thereof. A pair of grooves 271 are formed in a periphery of the receiving hole 27 opposite each other. An L-shaped slot 28 is formed in each arm 26. The receiving hole 27 communicates with the L-shaped slot 28.

The locking device 1 is formed by stamping a metal plate, and comprises a base 10, first and second folded sections 18, 14, and a pair of locking feet 13. The first and second folded sections 18, 14 extend from opposite edges of the base 10, and an opening 15 is formed in the second folded section 14. The locking feet 13 extend from the base 10 for insertion into a corresponding hole of a circuit board (not shown). The engaging member 12 forms a screw hole 16 for engaging with a screw (not shown) and securing the housing 21 to the circuit board. A pair of projections 17 oppositely extends from the engaging member 12 for engaging with the corresponding grooves 271 of the receiving hole 27, therefore, movement of the engaging member 12 is restricted.

The terminals 22 are inserted into corresponding passageways 24. Each terminal 22 has a contacting section 221, a mating section 222 and a soldering section 223. The contacting section 221 is received in the engaging portion 23 for electrically contacting a mating connector (not shown). The mating section 222 forms a plurality of barbs 2221 for engaging with the housing 21 and properly securing the terminal 22. The soldering section 223 is adapted to contact a corresponding soldering pad of the circuit board.

Figure 4:
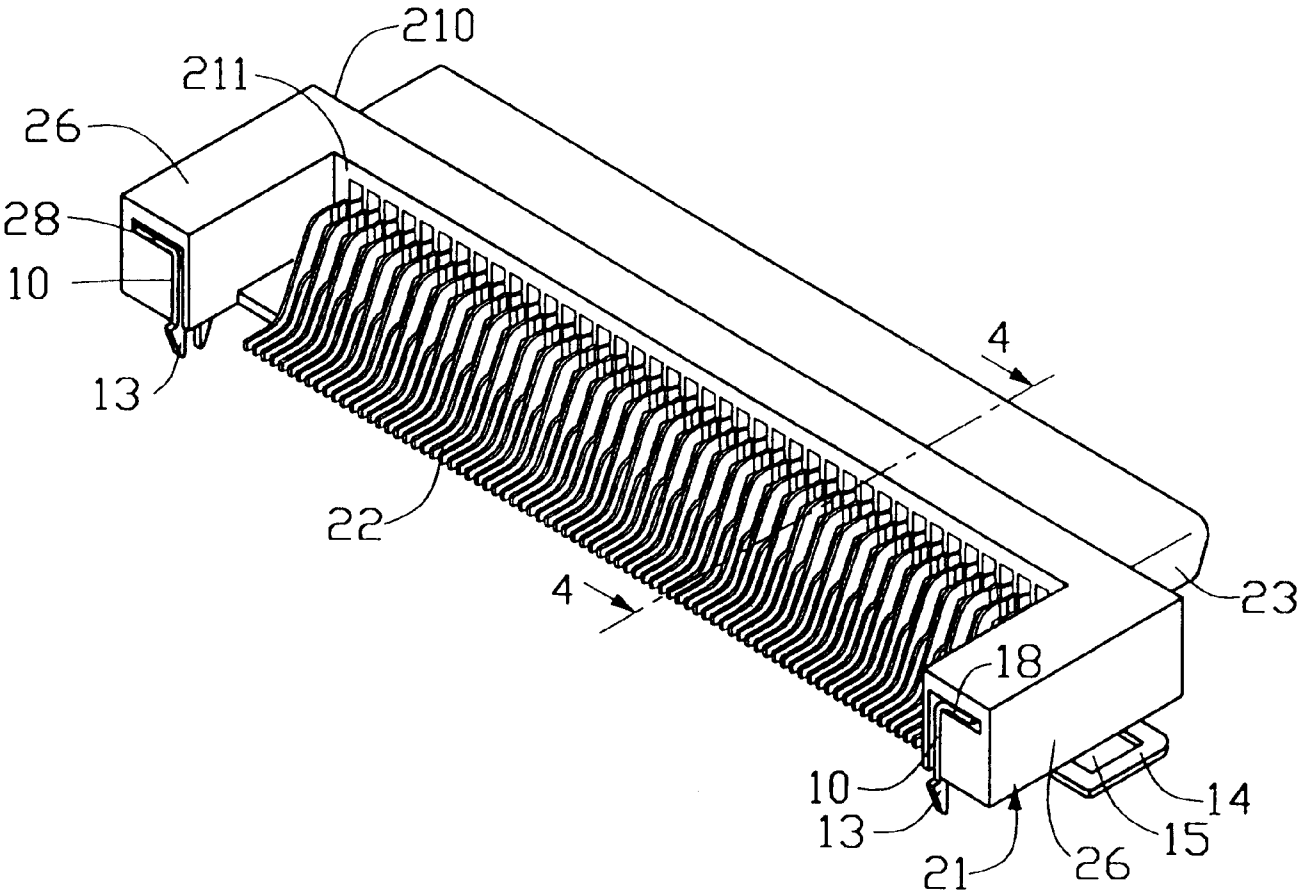
FIG. 4 is an assembled view of FIG. 2.
Figure 5:
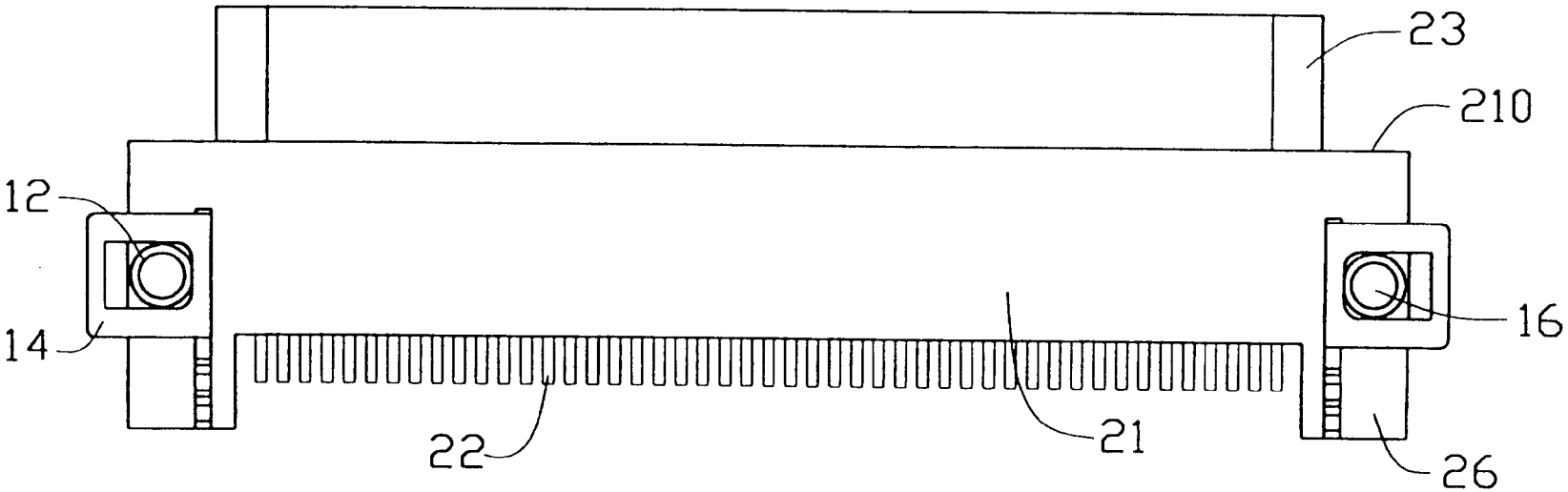
FIG. 5 is a rear view of FIG. 4.

Referring to FIGS. 4 and 5, in assembly the terminals 22 are inserted into the corresponding passageways 24 of the housing 21, and each terminal 22 is secured by the mating section 222. The soldering section 223 is properly positioned by the spacing slots 251 of the spacing portion 25. Each engaging member 12 is received in the corresponding receiving hole 27. The locking device 1 is then disposed in the corresponding L-shaped slot 28. Several protrusions 19 are formed on the base 10 for engaging with an inner surface of the L-shaped slot 28 and securing the locking device 1 in the housing 21. After assembly, the opening 15 of the second folded section 14 communicates with the screw hole 16 for receiving a screw, and the projections 17 of the engaging member 12 are positioned by inner edges of the second folded section 14. Therefore, the locking feet 13 extend through the circuit board and the engaging member 12 engages with a screw for securing the housing 21 to the circuit board. Thus, a reliable fixing force is provided to secure the electrical connector to the circuit board.

Figure 7:
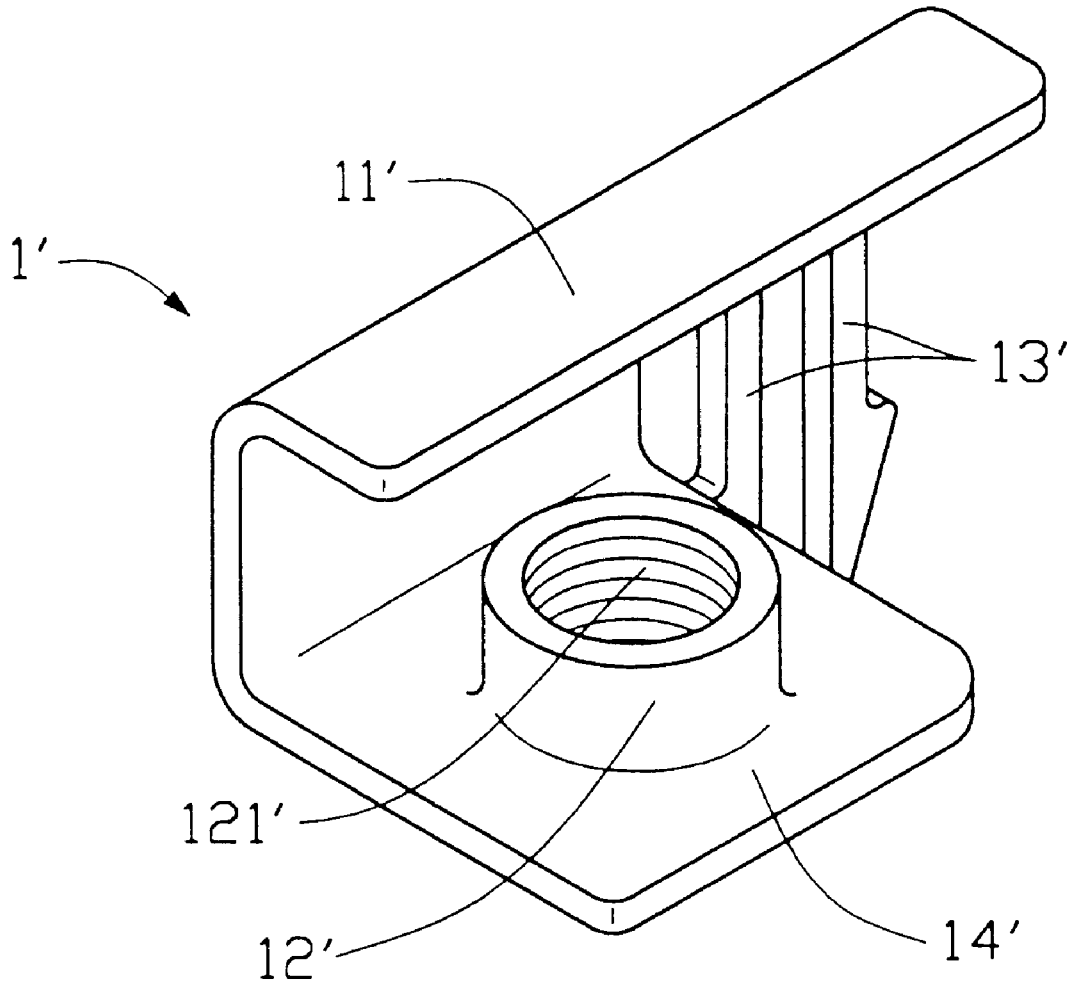
FIG. 7 is a perspective view of another embodiment of the locking device.

Referring to FIG. 7, in another embodiment of the invention, a locking device 1' comprises a locking device 11' and an engaging member 12'. The engaging member 12' is formed on a base 14' of the locking device 11' and defines a screw hole 121' for receiving a screw therein. The locking device 11' comprises a pair of locking feet 13' for engaging with corresponding locking holes of a circuit board. Also the housing 21 is designed with a slot to accommodate the locking device 1' (not shown), thus, the assembly process of attaching the locking device 1' to the housing 21 is simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having an engaging face, a rear face, an engaging portion formed on the engaging face, a plurality of passageways formed between the engaging face and the rear face, and a pair of arms extending laterally thereof each having a receiving hole;

a plurality of terminals each having one end secured in the corresponding passageway for engaging with a contact of a mating connector and the other end for being soldered to a solder pad on a circuit board;

an engaging member received in the corresponding receiving hole of each arm, the engaging member forming a threaded screw hole adapted for receiving a screw to secure the housing to the circuit board; and a locking device for each arm comprising a base, a first and second folded sections extending from opposite edges of the base, the first folded section engaging with the corresponding arm, the second folded section retaining the engaging member in the arm;

wherein an L-shaped slot is formed in each arm of the housing for receiving the base and the first folded section of the corresponding locking device;

wherein a plurality of protrusions is formed in the base of the locking device for engaging with an inner surface of the L-shaped slot, thereby securing the locking device to the housing;

wherein an opening is formed in the second folded section of the locking device for insertion of a screw into the screw hole of the engaging member;

wherein the projections of the engaging member are positioned by the second folded section for preventing linear movement in the receiving hole;

wherein a spacing portion is formed on the rear face of the housing and defines a plurality of spacing slots for properly positioning the corresponding terminals;

wherein a pair of feet extends from the base of the locking device for securing the electrical connector to the circuit board;

wherein a pair of projections oppositely extend from the engaging member for engaging with a pair of grooves formed in a periphery of the corresponding receiving hole for restricting a turning movement of the engaging member.

* * * * *